United States Patent [19]

Weideman

[11] 4,307,714

[45] Dec. 29, 1981

[54] APPARATUS FOR TREATING A PATIENT BY MEANS OF WATER SPRAYS

[75] Inventor: Andries C. Weideman, Parow North, South Africa

[73] Assignee: Antoinette van Zyl, South Africa

[21] Appl. No.: 132,569

[22] Filed: Mar. 21, 1980

[30] Foreign Application Priority Data

Feb. 9, 1979 [ZA] South Africa ..... 79/0581

[51] Int. Cl.[3] ..... A47K 3/10

[52] U.S. Cl. ..... 128/66

[58] Field of Search ..... 273/66, 65

[56] References Cited

U.S. PATENT DOCUMENTS 3,094,983 6/1963 MacLeod ..... 128/65
3,890,965 6/1975 Drew ..... 128/66
4,225,984 10/1980 Lindsey ..... 128/66

FOREIGN PATENT DOCUMENTS 2309411 8/1974 Fed. Rep. of Germany ..... 128/66
2710948 3/1977 Fed. Rep. of Germany ..... 128/66

*Primary Examiner*—Richard C. Pinkham
*Assistant Examiner*—T. Brown
*Attorney, Agent, or Firm*—Karl W. Flocks

[57] ABSTRACT

Apparatus for treating a patient by means of water sprays which includes a horizontal cylinder (10) which is open at one end and closed at the other. Nozzles (20,30 and 34) are provided for directing sprays of water and/or steam into the interior of the vessel. A pump (78), a water heater (80) and a steam generator (82) are provided and are connected to the nozzles by tubing. The patient lies on a trolley (40) which has a wheeled base (46). Vertical columns (44) at one end of the base support two elongate side members (42) which overlie the base and between which a mesh (52) or synthetic plastics sheet extends to support a prone patient. The trolley is oscillated horizontally to move the patient relatively to the nozzles by means of a crank arrangement (60,62) driven by an electric motor (56).

10 Claims, 5 Drawing Figures

APPARATUS FOR TREATING A PATIENT BY MEANS OF WATER SPRAYS

Figure 1:
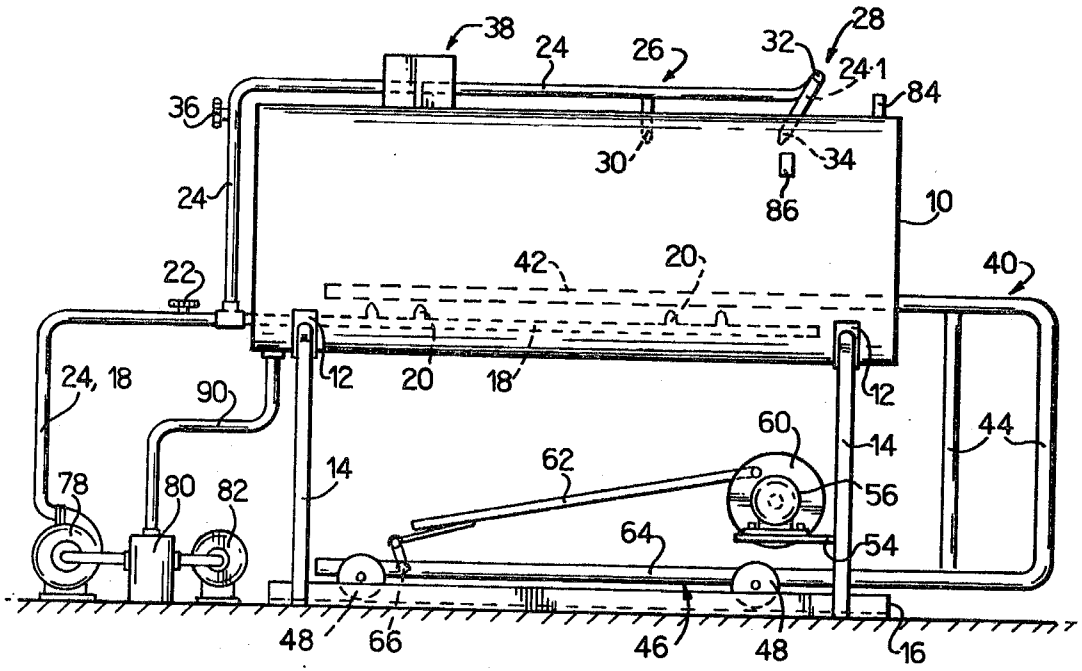

This invention relates to apparatus for treating a patient by means of water sprays.

It is known to immerse patients in natural spring water, or water with chemical agents added thereto, for the purpose of treating certain ailments. A problem with this method of treatment is that upwards of a hundred liters of water are used for each patient and the water can be used only once before being pumped away. Where the water contains additives these must be added in sufficient quantities to raise the concentration to the requisite level. The additives are lost after each treatment which is of significance where the additives are expensive.

If the patient is crippled, overweight or burned there are great difficulties in getting him into and out of the treatment bath.

Applicant is aware that treatment baths are commercially available, and that some of these have impellers located at below water level for causing the water in the bath to circulate. Sprays at below water level have also been proposed to set the water circulating.

The present invention seeks to provide a treatment apparatus in which only a relatively small amount of water is used for each patient, and in which the difficulties involved in handling the patient are minimised.

The present invention thus provides apparatus for treating a patient with water sprays, the apparatus comprising a horizontally elongate vessel which is open at one end and which receives a patient in a prone position, and a plurality of water nozzles for directing water jets at a patient lying within the vessel.

The apparatus can further include a trolley on which the patient is moved into and out of the vessel, the trolley including a mesh support for the patient.

The mesh support can be of netting.

The trolley can comprise two horizontally elongated side members with said mesh support extending between them, a wheeled base, and vertical columns at one end of the base for supporting said side members, the arrangement being such that when said trolley is wheeled up to the vessel said side members and the mesh support enter the vessel and the wheeled base passes underneath the vessel.

Means can be provided for oscillating said trolley so that a patient supported on said mesh support moves relatively to said nozzles.

A pair of parallel, spaced rails can be provided for guiding movement of said trolley with respect to said vessel. Said rails can be secured to legs which form part of a supporting frame for said vessel.

The means for oscillating said trolley can comprise a crank disc and a crank, the end of the crank remote from said disc being connected to the trolley, and the drive means for said crank can be mounted on said supporting frame.

The crank can be releasably connected to said trolley so that, when disconnected, the trolley can be wheeled away from the vessel to withdraw said side members and said mesh support from the vessel.

The vessel can be in the form of a horizontally elongate cylinder which is closed at one end and open at the other. The vessel can be of opaque, transluscent or transparent synthetic plastics material, of stainless steel or other suitable material.

Water inlet pipes can lead to said nozzles from a pump and water heater, and a drain can be provided at the lower end of the vessel for leading water back to the water heater.

A steam generator can be provided which maintains a body of water at just below boiling point, and which is heated to produce steam after a patient has been placed in the vessel.

The vessel can be provided with an off switch and a call signal button or the like within reach of a patient in the vessel.

A control unit can be provided for producing an initial flow of steam into the vessel and subsequently a period of water flow through the nozzles, the trolley being oscillated for at least the period that water is flowing through said nozzles. An alternative control unit can be used which detects the temperature at one of the nozzles, cuts off flow when the temperature rises above a predetermined value and restarts flow when the temperature drops to a predetermined value so that flow is intermittent.

Figure 2:
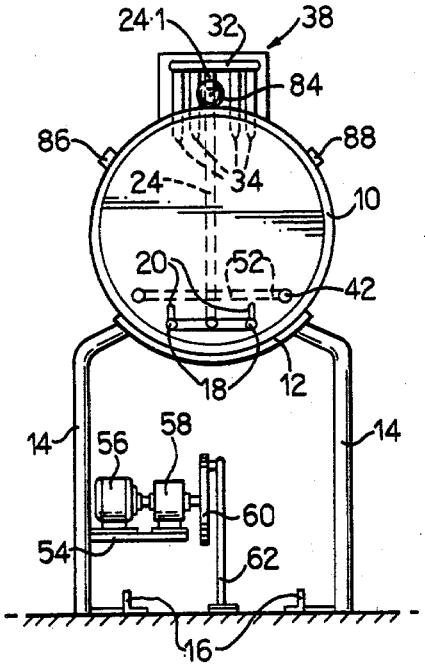
Figure 3B:
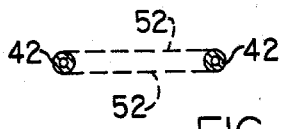
Figure 3A:
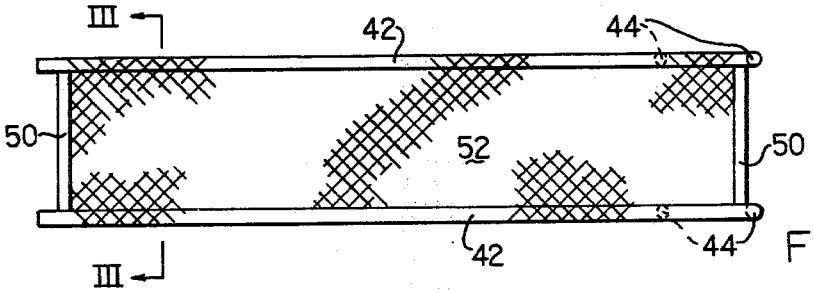
Figure 4:
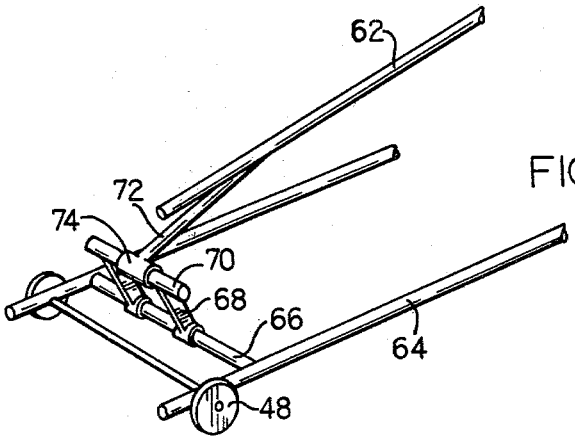

For a better understanding of the present invention, and to show how the same may be carried into effect, reference will now be made, by way of example, to the accompanying diagrammatic drawings in which:

FIG. 1 is a side elevation of hydro-massage apparatus in accordance with the invention, FIG. 2 is a diagrammatic end elevation of the apparatus of FIG. 1, FIG. 3*a* is a plan view of a trolley, FIG. 3*b* is a section on the line III—III of FIG. 3*a*, and FIG. 4 is a detail of a latching arrangement.

The hydro-massage apparatus illustrated comprises a horizontal cylinder 10 which is open at one end, the right hand end as viewed in FIG. 1, and closed at the other end. The cylinder is supported on a pair of arcuate bands 12 which are themselves mounted at the upper ends of legs 14. Two L-shaped, parallel, spaced-apart rails 16 are attached to the legs 14 and extend in the direction of the length of the cylinder 10. These rails form part of a supporting frame for the cylinder 10.

A pair of parallel water pipes 18 extend through the closed end of the cylinder 10 and each of them carries a series of upwardly directed nozzles 20. In the illustrated form each pipe 18 carries four nozzles but it will be understood that this number, and the spacing of the nozzles, can be varied as desired. A tap 22 is provided in each pipe 18 externally of the cylinder 10, and the pipes 18 connect to a pump and a hot water supply arrangement as will be described.

A further water pipe 24 runs along the top of the cylinder 10 externally thereof although it can be within the cylinder 10 if desired. The pipe 24 leads to two nozzle arrangements 26 and 28. The nozzle arrangement 26 comprises a tee-piece, the free end of the upright of the tee being connected to the pipe 24 and there being a nozzle 30 at each end of the cross-bar of the tee-piece. The nozzles 30 protrude downwardly through the wall of the cylinder 10 and are arranged generally vertically as can be seen from FIG. 1. The pipe 24 terminates in an inclined portion 24.1 which communicates with a cross pipe 32. Four nozzles 34 extend downwardly from the cross pipe 32 and through the wall of the cylinder. As will clearly be seen from FIG. 1, these nozzles are inclined so that the jets of water emerging from them converge with the jets of water emerging from the nozzles 30.

A tap 36 is provided in the pipe 24.

The reference 38 indicates a control box which is mounted on the cylinder 10. The cycle performed by the apparatus is controlled by this box.

A trolley 40 supports the patient to be treated in the cylinder 10, it being understood that the cylinder 10 does not support any part of the mass of the patient. The trolley 40 comprises two horizontally elongated side members 42 which are supported cantilever fashion by vertical columns 44 provided at one end of a wheeled base 46. The base 46 has four wheels 48, which are preferably castor wheels.

If reference is made to FIGS. 3*a* and 3*b* it will be seen that the trolley comprises, in addition to the side members 42, two cross members 50 which join the side members 42. A net 52 extends between the members 42, the net extending both above and below the members 42 so as to have upper and lower runs (FIG. 3*b*). The patient lies on the upper run and it will be understood that the net does not obstruct the water jets emerging from the nozzles 20 which thus impinge on the patient.

A motor platform 54 forms part of the supporting frame of the cylinder 10. An electric motor 56 and a reduction gearbox 58 are mounted on the platform 54, and the output shaft of the gearbox 58 drives a crank disc 60. A crank 62 is connected to the disc 60 adjacent its periphery.

The side members of the wheeled base 46 are referenced 64 and are joined by a plurality of cross bars one of which is shown at 66. At the centre of the cross bar 66 there is a pair of brackets 68 (FIG. 4) which support a short horizontal rod 70. The free end of the crank 62 has a ramp 72 secured to the underside thereof, the ramp terminating in a downwardly open semi-circular latch element 74. In the position shown in FIG. 4 the rod 70 is engaged in the element 74 so that, as the crank oscillates, the cross bar 66 and hence the entire trolley are oscillated with the crank. By lifting the crank 62 about its pivotal mounting on the crank disc 60, the rod 70 and element 74 can be detached one from the other. A foot pedal and lever (not shown) can be provided for lifting the crank 62.

The members 42 lie parallel to, and vertically above, the horizontal members 64 constituting the wheeled base 46. Only the members 42 of the trolley and its net have been shown in FIG. 2.

Externally of the cylinder 10 the pipes 18 and 24 are connected to a pump 78 and a water heater 80. Also provided is a steam generator 82. This generator is maintained, by means of a thermostat, at a temperature just below the boiling point of water until such time as steam is required. Thereupon the thermostatic control is overridden so that steam is generated.

While the apparatus is designed to perform an automatic cycle of steam injection and water spraying, at least the water spraying being accompanied by oscillation of the trolley 40, the patient is provided with certain controls which are within reach. Thus, a thermostat is shown at 84 in order that the patient can control the water temperature, a call button is shown at 86, and an off switch is shown at 88.

A drain pipe 90 leads from the bottom of the vessel 10 back to the water heater 80.

In use of the apparatus the end of the crank 62 remote from the disc 60 is lifted to release the element 74 from the rod 70. Thereafter, the trolley is wheeled away from the cylinder 10 (to the right as illustrated in FIG. 1) and the patient placed on the net 52. The trolley is then wheeled to the left so that the patient enters the cylinder 10 feet first. The rod 70 encounters the ramp 72 which at this time is resting on the floor. The rod 70 pivots the crank 62 and ramp 72 upwardly until it enters the latch element 74.

The steam and water injection cycle of the apparatus is then initiated. The water cycle can include a hot water stage and a cold water stage. After each stage the used water is pumped out and fresh water taken in.

The nozzles can be replaceable so that different spray patterns can be achieved. Roses such as are used in showers can be used in place of the single jet nozzles. Also the nozzles of different sizes can be used to provide coarse or fine sprays.

The incoming water can be treated so as to be enriched with oxygen or carbon dioxide, or can be passed through an ionising arc.

Galvanic pads can be applied to the patient before he is placed in the cylinder.

If the apparatus is to be used to treat burned patients the nozzles 20 are removed and further inwardly directed nozzles incorporated on the side walls of the cylinder 10. The net 52 is covered by, or replaced by, a sheet of synthetic plastics material to prevent injury to the patient by strands of the net.

In this form of the apparatus there can be an adjustable temperature regulator for controlling the temperature of the water in the heater 80. Additionally, there is a thermocouple or other temperature detector associated with the nozzles 34. The thermocouple is connected to an adjustable unit which operates in response to detection by the thermocouple of the temperature for which the unit is set. As soon as the unit operates the pump 78 is switched-off and comes on again when the temperature at the thermocouple drops. Thus the patient is sprayed intermittently rather than continuously. Additionally, a timer can be provided for switching the pump on and off for predetermined, adjustable intervals. The pump is thus off for a predetermined period and then on for another predetermined period, and while on operates intermittently as described above.

If mains pressure is sufficient the pipes 18, 24 can be connected directly to hot and cold taps and the pipe 90 to a drain. In this form somewhat more water is used per patient than in the recirculating form, but less than is required for a bath.

In a modified form of the apparatus the steam generator 82 is of a type which contains only a small quantity of water and which has a large wattage heating element. Thus, instead of continuously maintaining the water hot, the water remains at ambient temperature until required whereupon it is rapidly heated.

To treat burns it is possible to provide a hot water bath into which a container comprising sterilized water and medicament is placed. The container is connected to the suction inlet of the pump and, when its contents are at the correct temperature, the pump is started to spray the sterilized water onto the patient. The used water is not recirculated but runs to waste down the drain pipe 90.

I claim:

1. Apparatus for treating a patient by means of water sprays comprising a horizontally elongate vessel which is open at one end and which is adapted to receive a patient in a prone position;

a plurality of water nozzles for directing water jets at a patient lying within the vessel; and a trolley on which the patient is movable into and out of the vessel and having a mesh support for the patient, the trolley comprising two elongated side members with said mesh support extending between them, a wheeled base, and vertical columns at one end of the base for supporting said side members, the arrangement being such that when said trolley is wheeled up to the vessel, said side members and the mesh support enter the vessel and the wheeled base passes underneath the vessel.

2. Apparatus according to claim 1 and including means for oscillating said trolley so that a patient supported on said mesh support moves relatively to said nozzles.

3. Apparatus according to claim 2, in which the means for oscillating said trolley comprises a crank disc and a crank, the end of the crank remote from said disc being connected to the trolley.

4. Apparatus according to claim 1, in which said vessel is in the form of a horizontally elongate cylinder which is closed at one end and open at the other.

5. Apparatus for treating a patient by means of water sprays, comprising (a) a horizontally elongate vessel which is open at one end and which is adapted to receive a patient in a prone position;

(b) a plurality of water nozzles for directing water jets at a patient lying within the vessel; and (c) a trolley on which the patient is movable into and out of the vessel, the vessel comprising a wheeled base; a vertical column at one end of the base; and a patient support extending horizontally from and supported cantilever-fashion by the vertical column, the arrangement being such that when said trolley is wheeled up to the vessel, the patient support enters the vessel and the wheeled base passes underneath the vessel.

6. Apparatus as claimed in claim 1 or in claim 5, in which displacing means are provided for moving the water jets and trolley relatively to each other.

7. Apparatus as claimed in claim 5, in which displacing means are provided for moving the water jets and trolley relatively to each other, the displacing means comprising oscillating means for oscillating the trolley relative to the water jets so that, in use, a patient supported on the patient support is moved relatively to the jets.

8. Apparatus as claimed in claim 1 or claim 7, in which the vessel is in the form of an elongate cylinder which, being open at one end, is closed at the other end.

9. Apparatus as claimed in claim 1 or claim 5, which includes water supply means adapted to supply water under pressure to the nozzles, and in which water flow control means are provided at or near the open end of the vessel to be operable by a patient when lying inside the vessel on the trolley.

10. Apparatus as claimed in claim 1 or claim 5, which includes water flow control means for causing the water jets to spray the patient intermittently.

* * * * *